US011230884B2

(12) United States Patent
Brondex

(10) Patent No.: US 11,230,884 B2
(45) Date of Patent: Jan. 25, 2022

(54) DRIVE SYSTEM DRIVING A SCREEN, AND APPARATUS COMPRISING SUCH A SYSTEM

(71) Applicant: SOMFY ACTIVITES SA, Cluses (FR)

(72) Inventor: Adrien Brondex, Domancy (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 17/259,109

(22) PCT Filed: Jul. 10, 2019

(86) PCT No.: PCT/EP2019/068507
§ 371 (c)(1),
(2) Date: Jan. 8, 2021

(87) PCT Pub. No.: WO2020/011841
PCT Pub. Date: Jan. 16, 2020

(65) Prior Publication Data

US 2021/0246723 A1 Aug. 12, 2021

(30) Foreign Application Priority Data

Jul. 11, 2018 (FR) ..... 1856379

(51) Int. Cl.
*E06B 9/72* (2006.01)
*E06B 9/42* (2006.01)
*E06B 9/60* (2006.01)

(52) U.S. Cl.
CPC ..... *E06B 9/72* (2013.01); *E06B 9/42* (2013.01); *E06B 9/60* (2013.01)

(58) Field of Classification Search
CPC ..... E06B 9/72; E06B 9/60; E06B 9/42
See application file for complete search history.

(56) References Cited

U.S. PATENT DOCUMENTS 799,075 A * 9/1905 McCloud ..... E06B 9/60 160/318
1,561,551 A * 11/1925 Lewis ..... E06B 9/44 160/313
1,641,506 A * 9/1927 Smurr ..... E06B 9/60 160/315
2,765,843 A * 10/1956 Nilles ..... B60J 7/085 160/290.1

(Continued)

FOREIGN PATENT DOCUMENTS

WO 03/083245 10/2003

OTHER PUBLICATIONS

International Search Report for PCT/EP2019/068507 dated Oct. 8, 2019, 4 pages.

(Continued)

*Primary Examiner* — Beth A Stephan
(74) *Attorney, Agent, or Firm* — Nixon & Vanderhye

(57) ABSTRACT

Disclosed is a drive system for driving a screen, that includes an actuator designed to drive in rotation a winding tube acting on the screen, and a compensation spring which is mounted around the actuator and has several turns formed by winding a wire. The drive system includes at least one ring made of plastic material that is placed between two adjacent turns of the compensation spring, and an external radius of the ring is larger than a maximum external radius of the compensation spring.

22 Claims, 7 Drawing Sheets

(56) References Cited

U.S. PATENT DOCUMENTS

| | | | | | |
|---|---|---|---|---|---|
| 4,429,729 | A * | 2/1984 | Winslow | E06B 9/60 | 144/193.1 |
| 5,078,198 | A * | 1/1992 | Tedeschi | E06B 9/60 | 160/301 |
| 5,419,010 | A * | 5/1995 | Mullet | E05D 13/1261 | 16/198 |
| 5,964,426 | A * | 10/1999 | Tabellini | E06B 9/60 | 160/316 |
| 5,996,923 | A * | 12/1999 | Junquera | E06B 9/44 | 160/315 |
| 9,027,625 | B2 * | 5/2015 | Persson | B65H 75/486 | 160/23.1 |
| 2008/0073039 | A1 * | 3/2008 | Gyngell | E06B 9/60 | 160/313 |
| 2008/0196846 | A1 * | 8/2008 | Glasl | B60J 1/2033 | 160/313 |
| 2012/0000615 | A1 | 1/2012 | Lin | | |

OTHER PUBLICATIONS

Written Opinion of the ISA for PCT/EP2019/068507 dated Oct. 8, 2019, 5 pages.
Search Report for FR1856379 dated Mar. 20, 2019, 2 pages.

* cited by examiner

DRIVE SYSTEM DRIVING A SCREEN, AND APPARATUS COMPRISING SUCH A SYSTEM

The invention relates to a drive system for driving a screen, in particular a roll-up screen. The invention also relates to an installation for a closure system, screening/blackout system or solar protection system that comprises such a drive system.

BACKGROUND OF THE INVENTION

In a conventional manner, an installation for a closure system, screening/blackout system or solar protection system comprises a movable screen that is movable between two positions referred to as end-of-travel positions, in particular a roll-up screen, such as a flexible shutter-apron, for example a shutter-apron formed by slats connected to one another in an articulated manner in the case of a roller shutter, or screening material. The closure system installation also comprises a winding shaft, for example a winding tube on which is fastened and wound the roll-up screen or a shaft on which is wound a cord or a tape of the screen. The installation also includes a drive system that comprises an actuator comprising an electric motor, the actuator driving the winding shaft in rotation in order to deploy or retract the screen. The screen is therefore moved so as to be facing an opening in order to selectively close the latter. The weight of this screen (weight of the shutter-apron itself or the weight of a bar referred to as weighted "front bar", intended to facilitate the lowering of a screening material, under the effect of the combined weight of the screening material and the front bar) exerts on the drive system a variable torque, in particular as a function of the position of this screen.

In a conventional installation, with the unwinding or lowering of the screen taking place under the effect of the weight of the unwound portion of the screen, the consumption of electrical power is minimal. On the other hand, the forces to be exerted in order to wind up or raise the screen are substantial and therefore induce a penalty in terms of the overall consumption of electrical power by the installation.

The object of the present invention is to provide a closure system—, screening/blackout system—, or solar protection system installation, as defined above, whereof the consumption of electrical power is low, in which, for example, the actuator is supplied with power by means of an independent current source, for example by cells or batteries.

A known practice in the prior art, in order to reduce the power consumption of a screen drive system, is to use springs referred to as "compensation" springs so as to at least partially compensate for the variable torque created by the shutter-apron.

Such a compensation spring makes it possible to generate a torque between a fixed part of the actuator and the winding shaft, this spring being kinematically connected, by one of its ends, with a fixed structure and, by its other end, with a movable part that is connected to the screen, in particular connected to the winding shaft. The purpose of the compensation spring is to accompany the geared motor forming the actuator during the raising of a screening material or another type of screen. The patent document WO 03/083245 describes a drive system that comprises such a compensation spring.

In order for an installation to function correctly, it is necessary for the compensation force exerted by the spring to be appropriate to the torque developed by the screen which has an impact on the drive means. This torque is a function of the parameters relating to the screen drive system, for example the winding diameter, the dimensions of the screen, its specific weight and its position in relation to the opening. The parameters of the compensation spring, in particular the length of wire and/or the number of turns, are determined as a function of the parameters relating to the drive system for driving the screen. In addition, in order to allow for better balancing of the drive system, the control means for controlling the initial stress of a compensation spring may be provided. At the time of installing the drive system, the electric motor itself may be used for pre-stressing the compensation spring, in order to adjust the point of equilibrium of the screen. This equilibrium point is preferably provided at a point that is differentiated from the end-of-travel positions of the screen, for example at the mid-point of travel of the screen.

As the compensation spring gets placed progressively under stress, that is to say gets wound about itself and its diameter decreases, it gets elongated. In known systems, the design therefore provides for the installation to stretch the spring in order to provide for sufficient space for the completely wound configuration thereof. In this case, the length of the installed compensation spring is greater than its length at rest and the turns of the installed compensation spring are non-contiguous. This solution is not entirely satisfactory because in this case the spring is not maintained in place, is unstable and generates noise.

Indeed, in particular in the configuration where the compensation spring is installed around the actuator and within the interior of a winding tube, the radial space for the extension or the displacement of the turns in relation to the axis of the winding tube is very limited. Contact between the turns of the spring and the actuator and/or the winding tube generates noise in operation, which is unacceptable.

The patent document US 2012/000615 describes a drive system for driving a screen, which comprises by way of sole source of torque a spring which is radially isolated from a winding tube by a plastic sleeve. This prior art relates to systems without an electric actuator and produces noise due to the turns of the spring being in contact with one another.

SUMMARY OF THE INVENTION

It is these drawbacks that the invention seeks to remedy by providing a novel drive system that makes possible the reduction of the noise caused by the spring despite the limited space for mounting thereof.

To this end, the invention relates to a drive system for driving a screen, that comprises an actuator designed to drive in rotation a winding tube acting on the screen, and a compensation spring, which is mounted around the actuator and has several turns formed by winding a wire. This system is characterized in that it comprises at least one ring made of plastic material that is placed between two adjacent turns of the compensation spring, and in that an external radius of the ring is greater than a maximum external radius of the compensation spring.

Thanks to the invention, the inter-turn rings made of plastic material prevent noisy metal-to-metal contact between the spring and the winding tube.

According to advantageous but non-mandatory aspects of the invention, such a drive system may incorporate one or more of the following characteristic features, taken into consideration in accordance with any technically feasible combination:

The ring comprises a cylindrical external wall that comes into contact with an internal surface of the winding tube.

The width of the external wall is greater than the diameter of the wire that constitutes the compensation spring, in particular multiple times greater than the diameter of the wire that constitutes the compensation spring.

The ring comprises a cylindrical internal wall and an internal radius of the ring is less than a minimum internal radius of the compensation spring.

The width of the internal wall is greater than the diameter of the wire that constitutes the compensation spring, in particular multiple times greater than the diameter of the wire that constitutes the compensation spring.

The ring has an attachment means for attaching to a turn.

The ring has a circumferential length that is greater than one turn of rotation of the compensation spring about a central axis of the drive system.

The drive system comprises a plurality of rings that are each placed between two adjacent turns of the spring distributed at different locations of the spring along the central axis.

The compensation spring comprises a first series of turns, referred to as contiguous turns, which have at rest a first spacing; and at least one second series of turns, referred to as non-contiguous turns, which have at rest a second spacing with a value that is greater than the value of the first spacing.

The invention also relates to an installation for a closure system, screening/blackout system or solar protection system that comprises a screen, a frame, a winding tube, and a drive system as mentioned above.

BRIEF DESCRIPTION OF THE DRAWINGS

The invention will be better understood and other advantages thereof will be more clearly apparent in the light of the description which follows, provided by way of non-limiting example with reference to the appended drawings in which.

DETAILED DESCRIPTION OF THE PREFERRED EMBODIMENTS

Figure 1:
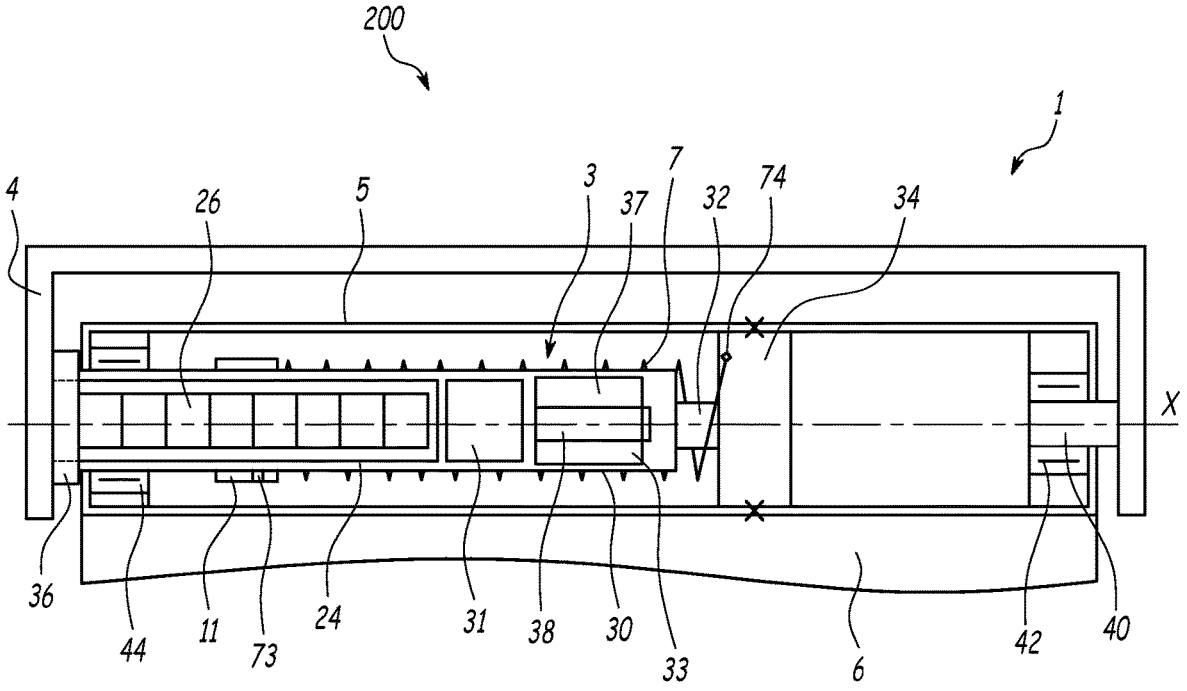
FIG. 1 is a schematic view of a closure system—, screening/blackout system—, or solar protection system installation that comprises a drive system in conformity with the invention.

FIG. 1 represents a closure system—, screening/blackout system—, or solar protection system installation 200 that comprises a screen 6, a frame 4, a winding shaft 5, and a drive system 1 for driving the screen 6, in particular a roll-up screen, such as a roller shutter, mounted in a framework of a door opening or window opening of a building. The drive system 1 comprises an actuator 3 designed to drive in rotation the winding shaft 5 in the form of a winding tube of the roll-up screen, and a compensation spring 7 that transmits to the winding shaft 5 a torque delivered by the actuator 3. The frame 4 supports the winding shaft 5.

Also defined is a central axis X or reference axis of the drive system 1, which is a longitudinal axis of the winding shaft 5, the actuator 3, and the compensation spring 7 in the assembled configuration. In the following sections, the terms "axial" and "radial" are used with reference to this central axis X.

The actuator 3 is mounted at least partially within the interior of the winding tube 5 and drives the latter in rotation by means of a connecting component part or drive wheel 34. The winding tube 5 is mounted so as to have the ability to rotate in the frame 4 by means of plain bearings or rolling bearings 42, 44. The actuator 3 is also disposed along the central axis X. It comprises a tubular housing or tubular casing 30, and housed within the tubular casing 30, a power supply assembly 24, that comprises for example accumulators or power supply batteries 26, an electronic control unit 31, an electric motor 33, as well as a reduction gear and a brake (not shown). Alternatively, the power supply assembly 24 may be housed within a second tubular casing, connected to the tubular casing 30 in which the electric motor 33 is located. The compensation spring 7, working under torsion around the central axis X, is mounted around the tubular casing 30 and acts so as to return the screen 6 to a rolled-up position.

The electric motor 33 of the actuator 3 has a stator 37 that is fixed relative to the casing 30, and a rotor 38 that drives, by means of the reduction gear, an output shaft 32. The output shaft 32 drives the winding tube 5 by means of the wheel 34 that is rotationally attached on the output shaft 32 and on the winding tube 5. The electronic control unit 31 ensures the operation of the electric motor 33, in accordance with the movement commands received, by bringing about the connection between the power supply from the accumulators or batteries 26 and the electric motor 33. In this embodiment, the actuator 3 comprises a head 36, which closes one end of the casing 30, and protrudes out to the exterior of the winding tube 5. The head 36 of the actuator serves as the means for supporting the actuator 3 on the frame 4 and consequently for supporting the winding tube 5 at the locational position of a fixed part of the building. In addition, it serves to enable torque take-up at the actuator output. It may be provided with an access hatch, not shown, for accessing the accumulators or batteries 26 contained in the tubular casing 30. The winding tube is supported on the frame at the end opposite to the head 36 of the actuator on a shaft 40 of the frame 4.

An attachment part 11 is situated on the tubular casing 30 and fixed so as to be in rotational and translational motion in relation to the tubular casing 30.

The compensation spring 7 may, in a known manner, be made up of one or more resilient elements, such as torsion springs, positioned in series, in order to obtain the desired characteristic features in terms of extension and stiffness. The compensation spring is shown in FIG. 1 partially masked by the tubular casing 30, so as to simplify the figure. The compensation spring 7 is fastened to the attachment points of the drive system 1: on the one hand by a first end 73 to the attachment part 11 that is mechanically bound to the casing 30, and on the other hand by a second end 74 to the drive wheel 34. By way of a variant, the second end 74 may be fastened to the output shaft 32.

The attachment part 11 is fastened on the casing 30 in a manner so as to be non-rotating and not movable in translational motion along the central axis X. The first end 73 of the compensation spring 7 is therefore connected to a fixed part of the actuator 3, by means of the attachment part 11, while the second end 74 is connected to a rotating part of the actuator 3 or to the winding shaft 5. In FIG. 1, the compensation spring 7 is shown unstretched and fastened only to the drive wheel 34 and not to the attachment part 11.

Figure 2:
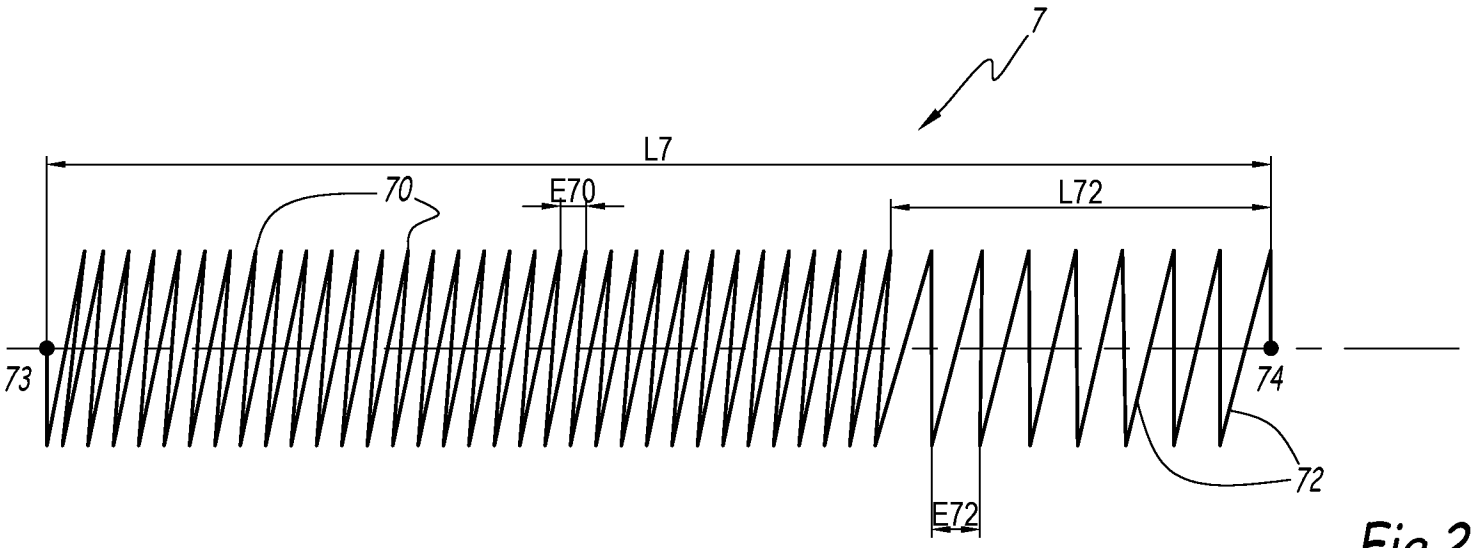
FIG. 2 is a schematic lateral view of a compensation spring of the drive system of FIG. 1 at rest.
Figure 3:
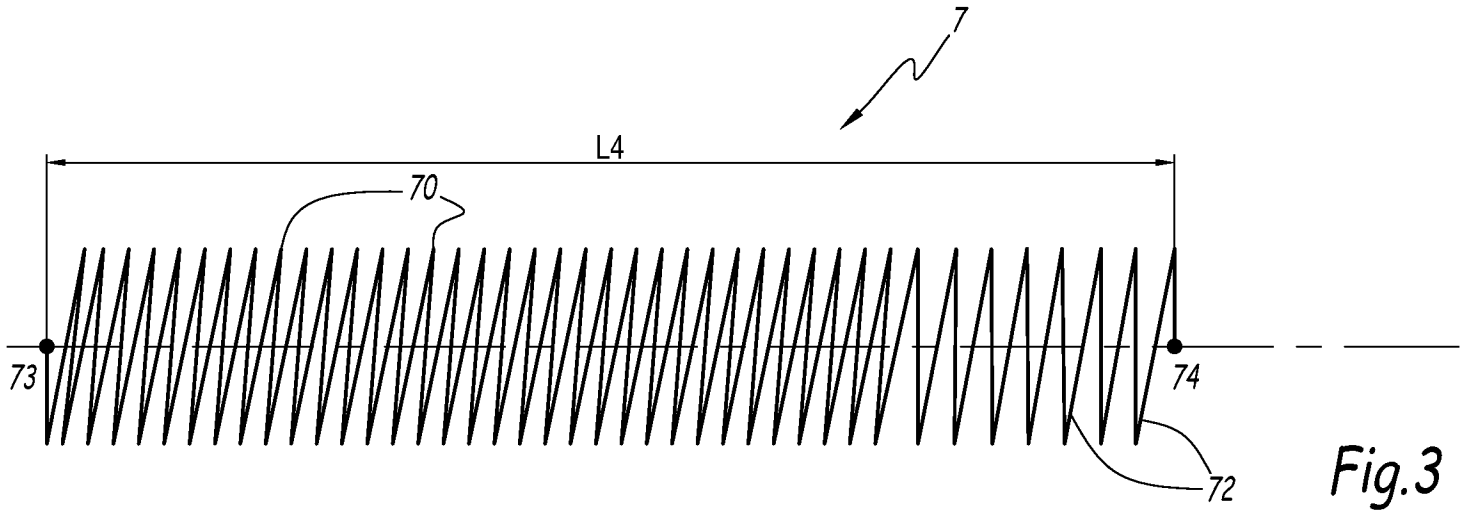
FIG. 3 is a view similar to that of FIG. 2, in a mounted configuration of the compensation spring.

The compensation spring 7 represented in a schematic manner in FIGS. 2 and 3, may, in a known manner, be made up of one or more resilient elements, such as torsion springs, formed by a spring wire wound in a helix. These torsion springs may be positioned in series, in order to obtain the desired characteristic features in terms of extension and stiffness.

The reference L7 denotes the length of the compensation spring 7 at rest, taken along the direction of the reference axis X. The reference L4 denotes the length between the drive wheel 34 and the attachment part 11 along the same direction. This length L4 corresponds substantially to the length of the compressed compensation spring 7. The reference L3 denotes the length of the actuator 3 taken along the same direction. The lengths L7 and L4 are less than the length L3 and the compensation spring 7 does not project out substantially beyond the ends of the actuator 3, which provides the actuator sub-assembly with a compact and monolithic character, thereby simplifying the handling thereof and allowing for savings in installation time.

According to a first embodiment, the compensation spring 7 comprises a first series of turns 70, referred to as contiguous turns, having at rest a first spacing E70; and at least one second series of turns 72, referred to as non-contiguous turns, having at rest a second spacing E72 with a value that is greater than the value of the first spacing E70.

According to a second embodiment, the compensation spring 7 is a spring with contiguous turns at rest, which is stretched prior to being fastened between the two attachment points, in a manner such that its length L8 when it is positioned is greater than its length L7 at rest. All the turns are then non-contiguous.

When the drive system 1 is in the operating configuration, the rotation of the electric motor results in the rotation of the drive wheel 34 and a modification in the torque applied to the compensation spring 7, since its second end 74 rotates around the reference axis X with the drive wheel 34 while its first end 73 remains stationary in relation to the tubular casing 30 of the actuator 3 which is itself stationary in relation to the reference axis X.

The modification of the torque applied to the compensation spring 7 modifies its extension, which has the effect of modifying the diameter of the turns and the spacing between the turns of which it is constituted, given that the spacing between the two ends 73 and 74 of the compensation spring 7 is fixed. In particular, when the compensation spring 7 is stressed (that is to say, that it gets wound about itself), its length increases and when the stress is relaxed, the length of the compensation spring 7 decreases.

These variations in length and therefore in diameter are to be taken into account at the time of sizing the compensation spring 7 so as to ensure that the latter is suitable for the installation 200 for a closure system, screening/blackout system or solar protection system.

In order to limit the noise impact of the drive system 1, the compensation spring 7, which is metallic, should be arranged at some distance from any metallic parts. More particularly, contact with the winding tube 5, generally metallic, is to be avoided.

To this end, the system 1 comprises at least one ring 9 that is placed between two adjacent turns 70 and 71 of the compensation spring 7. The ring 9 is made of plastic material, for example polyoxymethylene (POM) or the like, which makes it possible to ensure reduced friction between the turns 70 and 71.

The ring 9 comprises a cylindrical external wall 94 that comes into contact with an internal surface 50 of the winding tube 5. The ring 9 comprises a cylindrical internal wall 95 that comes into contact with an external surface 302 of the tubular casing 30. The ring 9 also comprises lateral walls 97 or 98 concave shaped walls, of which the radius of curvature is substantially equal to the radius of the wire that constitutes the compensation spring 7.

These rings 9 have an internal radius R95 that is less than a minimum internal radius R7 of the compensation spring 7 and they therefore come into contact with the tubular casing 30 in place of the compensation spring 7. By way of example, the internal radius R95 may be between 90% and 99% of the radius on R7, or else may be less than the radius R7 by 0.1 to 1 mm. Thus, the ring 9 always remains closer than the compensation spring 7 to the tubular casing 30, which thereby prevents any contact between the compensation spring 7 and the tubular casing 30.

In the same way, the rings 9 have an external radius R94 that is greater than a maximum external radius R8 of the turns of the compensation spring 7 and they therefore come into contact with the winding tube 5 in place of the compensation spring 7. By way of example, the external radius R94 may be between 101% and 110% of the radius R8, or else may be greater than the radius R8 by 0.1 to 1 mm. Thus, the ring 9 always remains closer than the compensation spring 7 to the winding tube 5, which thereby prevents any contact between the compensation spring 7 and the winding tube 5.

Thanks to the ring 9, a plastic-to-metal contact is brought about between the winding tube 5 and the ring 9—which produces only a negligible noise, rather than a metal-to-metal contact between the compensation spring 7 and the winding tube 5—which is far more noisy, and significantly more so since the surfaces of the ring 9 and of the winding tube 5 are in relative displacement with respect to each other during the operation of the installation 200. In the same manner and for the same reasons, a plastic-to-metal contact between the tubular casing 30 and the ring 9 is brought about. In addition, this solution makes it possible to ensure satisfactory radial compactness, since it is not necessary to provide for a substantial radial space between the tube 5 and the compensation spring 7, nor between the tubular casing 30 and the compensation spring 7.

The ring 9 is formed by a ring that is not closed, that is to say not forming a complete circumference around the axis X. The ring 9 has two ends 91 and 92.

Figure 7:
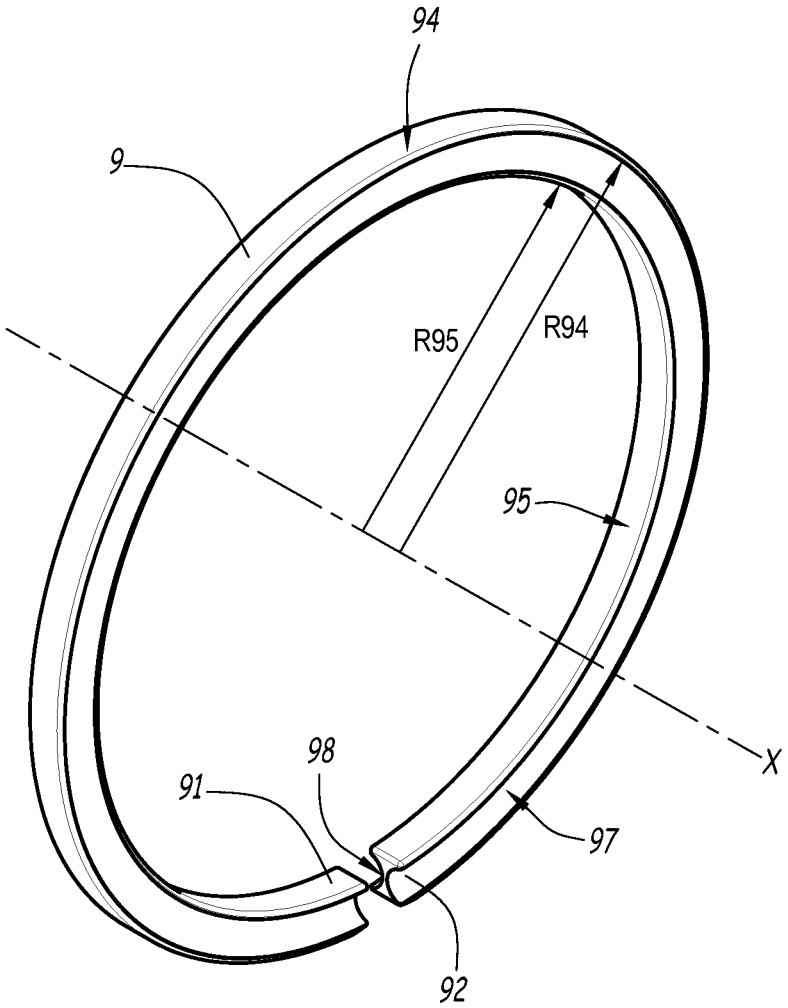
FIG. 7 is a perspective view of the ring shown in FIG. 5, in an unstressed configuration according to a first embodiment.

The circumferential length of the rings 9, that is to say taken around the central axis X, is greater than one turn of rotation of the compensation spring 7 around the axis X, in order to ensure the continuous contact of the plastic material of the rings 9 with the winding tube 5. This results from the fact that the ring 9 has two ends 91 and 92 which are juxtaposed. When the ring 9 is in a free state as shown in FIG. 7, that is to say in the absence of mechanical stress, the ends 91 and 92 are not juxtaposed. In an assembled state between the turns 70 and 71, the ring 9 is mechanically stressed by the form of the compensation spring 7 in a manner such that its diameter is reduced and its ends 91 and 92 are axially juxtaposed. Thus, the external radius R8 and the internal radius R7 of the compensation spring 7 or the equivalent diameters also vary with the diameter of the turns of the compensation spring 7.

Figure 4:
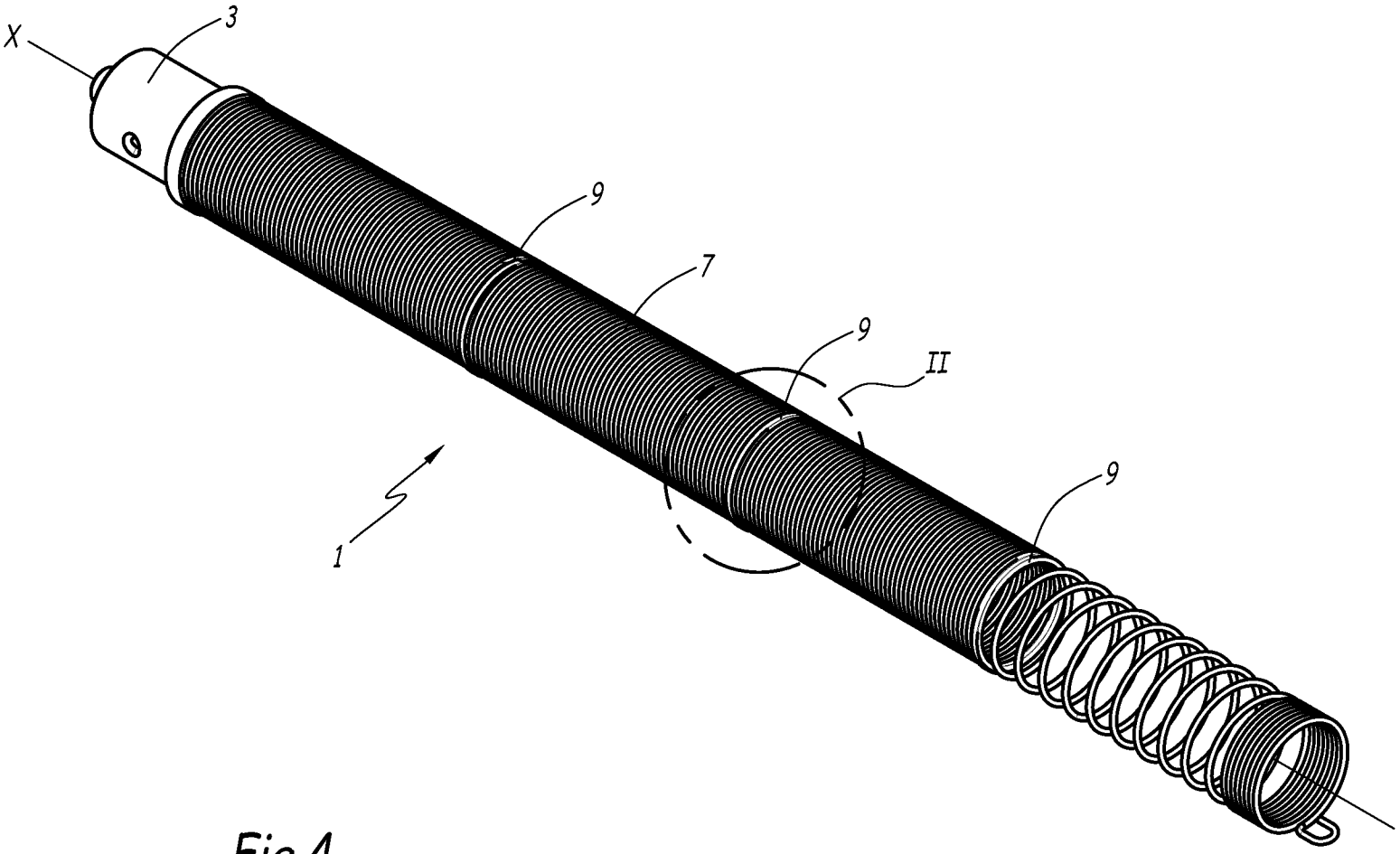
FIG. 4 is a partial view of the compensation spring of a drive system in conformity with the invention.
Figure 5:
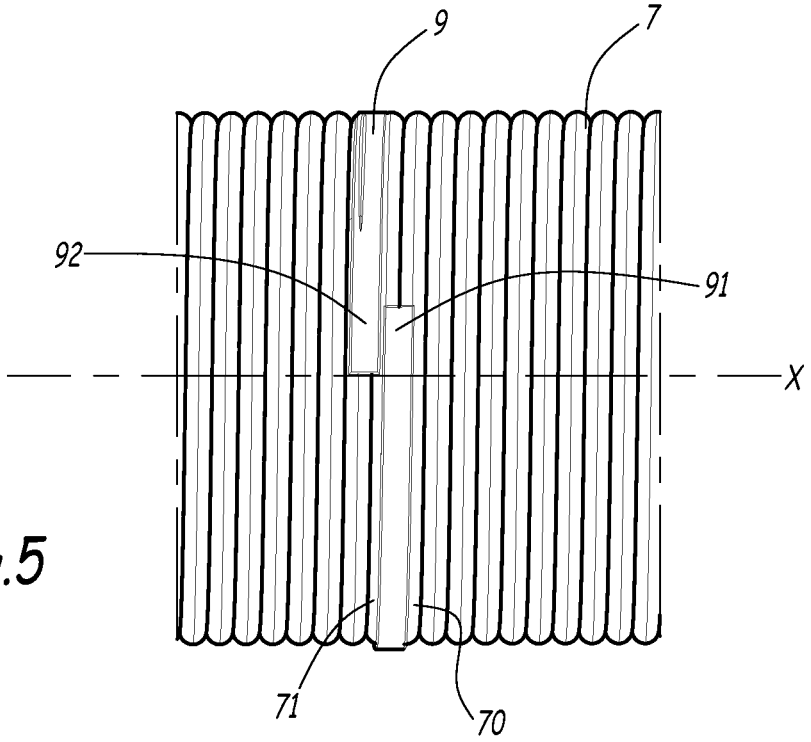
FIG. 5 is a side view, showing a spring and a ring of the system of FIG. 1.
Figure 6:
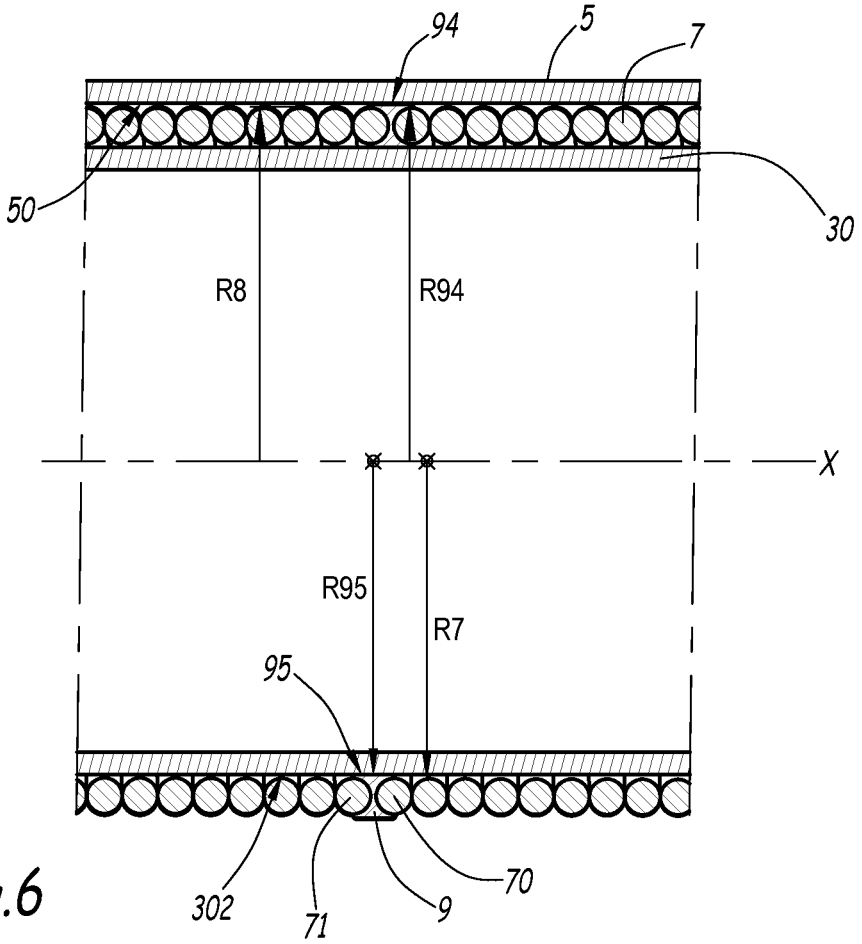
FIG. 6 is a longitudinal cross section of the system of FIG. 1 according to a first embodiment.

The number of rings 9 may vary according to the length of the compensation spring 7 and the axial position of the rings 9 is ensured by a slight axial preloading force exerted on the compensation spring 7. In this example, the system 1 comprises three rings 9 visible in FIG. 4.

A ring 9 as shown in FIGS. 4 to 7 may easily be positioned between two contiguous turns 70 and 71 in the first embodiment.

A second and a third embodiment are represented in FIGS. 8 to 11. In these embodiments, the elements common to the first embodiment bear the same references and operate in the same manner.

It is necessary to provide the means for maintaining the ring 9 properly positioned between two turns, including when the latter are spaced apart from one another.

Figure 8:
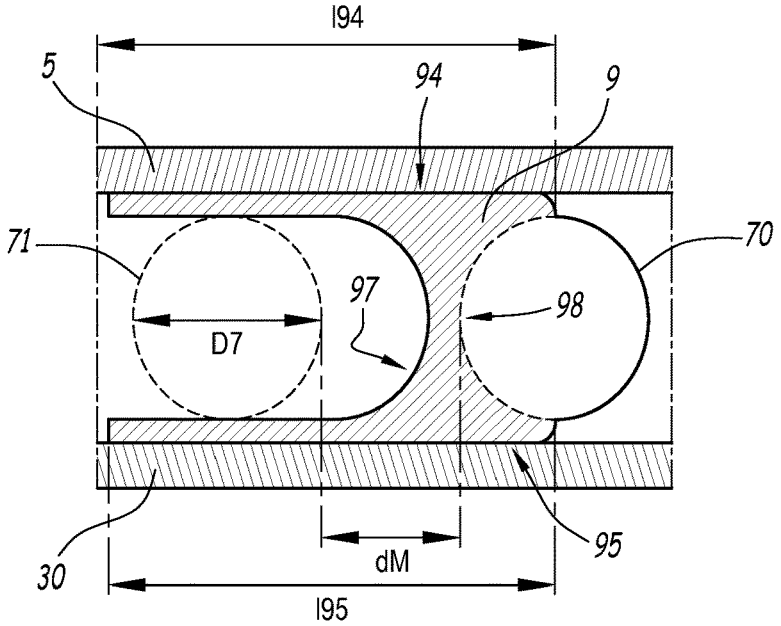
FIG. 8 is a longitudinal cross sectional view of a part of a drive system that is in conformity with a second embodiment.

In the second embodiment represented in FIG. 8, the external wall 94 and internal wall 95 of the ring 9 have a respective width 194, 195, taken along the central axis X, that is preferably greater than the diameter D7 of the wire that constitutes the compensation spring 7, in particular multiple times greater than the diameter D7 of the spring wire. In other words, the width 194 or 195 of the external wall 94 and/or the internal wall 95 is chosen so as to be greater than the maximum distance dM between two turns 70 and 71 plus the diameter D7. Thus, even in the case where the ring 9 is installed between two non-contiguous turns 70 and 71, it remains held in place by at least two adjacent turns 70 and 71 that are spaced apart from one another. Alternatively, in a manner that is not represented, only the internal wall 95, respectively the external wall 94 may have a width that is greater than the diameter D7. The internal wall 95, respectively the external wall 94 may have a width that is greater than the diameter D7 on each axial side of the ring 9 or else only on one side.

In a manner that is not represented, it may be provided for the widths 194, 195 to be less than the diameter D7 at the ends 91, 92 that are intended to overlap. Alternatively, the length of the ring 9 may be chosen such that the two ends 91 and 92 are spaced apart from one another when the ring 9 is used with the minimum diameter of the turns, that is to say the place of the compensation spring 7 where the turns have the smallest diameter in relation to the central axis X. This makes it possible to prevent the external wall 94 and/or internal wall 95 of a first end 91 from overlapping with the external wall 94 and/or internal wall 95 of a second end 92.

Figure 9:
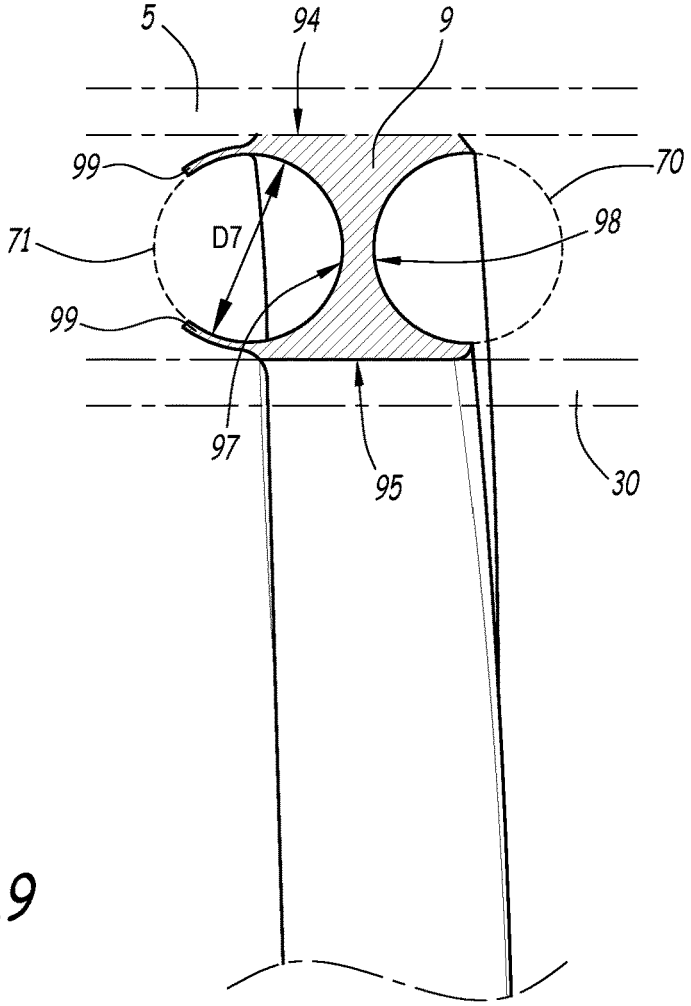
FIG. 9 is a longitudinal cross sectional view of a part of a drive system that is in conformity with a third embodiment.

According to a third embodiment represented in FIG. 9, the ring 9 may comprise at least one attachment means for attaching to a turn 71 on at least one of the lateral walls 97 or 98 of the ring 9. This attachment means may for example take the form of a C-shaped clip, formed by two tabs 99, of complementary shape having the diameter D7*et* in which it is possible for a turn 71 to be housed and remain held in place. Thus, even in the case where the ring 9 is installed between two adjacent turns 70 and 71 that are not contiguous, it remains held in place at one of the two adjacent turns. One or more attachment means may be provided over the circumferential length of the ring 9, while ensuring that the latter are arranged at a distance from the ends 91 and 92 of the ring 9, in order to avoid an overlap.

Alternatively, by way of a variant not shown, the attachment means may be provided over the entire circumferential length of the ring 9 with the exception of the ends 91 and 92 that overlap each other. Alternatively, the attachment means may be provided over the entire circumferential length of the ring 9 in the case where the circumferential length of the ring 9 is chosen such that the two ends 91 and 92 are spaced apart from one another when the ring 9 is used with the minimum diameter of the turns and therefore does not overlap.

Figure 10:
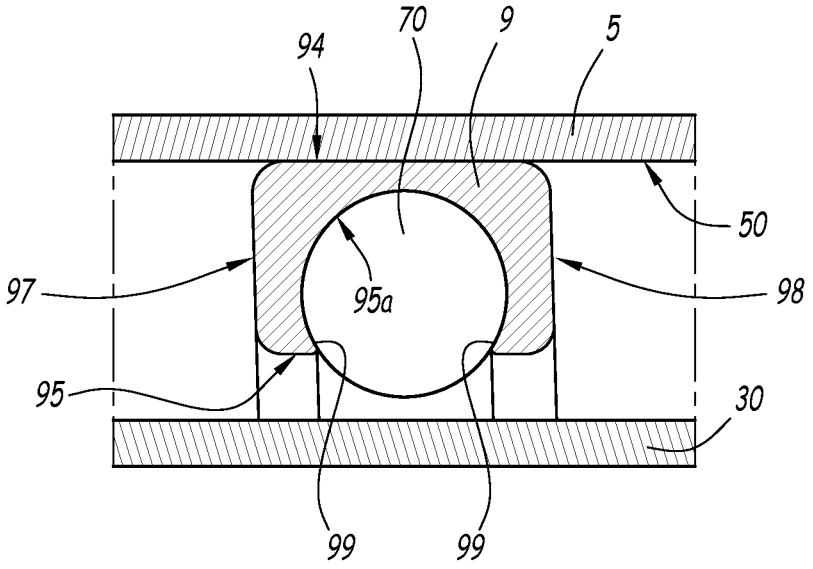
FIGS. 10 and 11 are views similar to that of FIG. 9 which represent variants of the third embodiment.

As represented in FIG. 10, the ring 9 may comprise a concave surface 95*a* provided on the internal wall 95. The concave surface 95*a* is adapted so as to accommodate a turn 70 of the compensation spring 7. The concave surface 95*a* has a concavity that is oriented to be facing the tubular casing 30. The concave surface 95*a* has converging edges 99 that constitute the attachment means integrally formed with the ring 9 and serves the purpose of firmly retaining the turn 70. The internal wall 95 is thus then not in contact with the tubular casing 30. In in this case, the lateral walls 97 and 98 may be planar axial surfaces.

The attachment means may be provided on only one of the lateral walls 97 and 98, while the second opposite lateral face does not have elements projecting outwards axially, as can be seen in FIG. 9. Thus, the risks of overlapping are eliminated.

Figure 11:
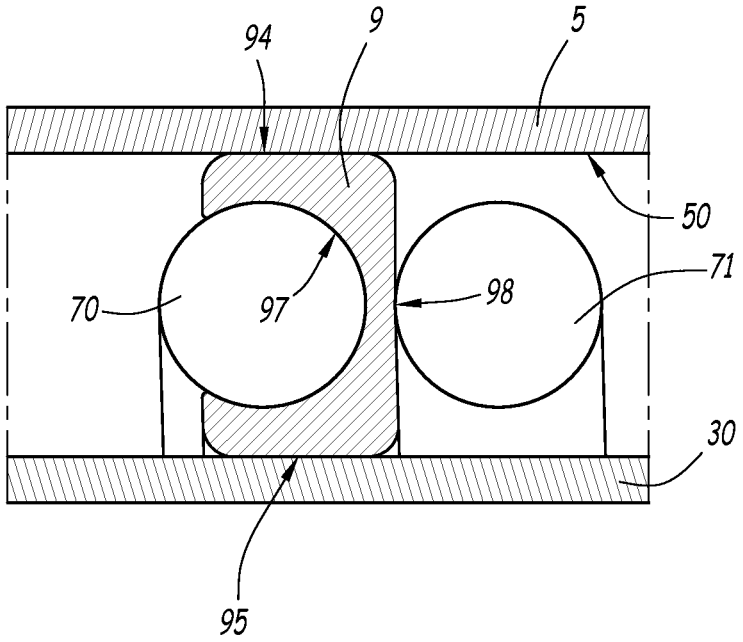

As represented in FIG. 11, the ring 9 may have the attachment means for attaching a turn 70 on the side of the lateral wall 97 of the ring 9, and on the other side, a lateral wall 98 formed by a planar axial surface. This planar axial surface serves as a support for a second turn 71 that is adjacent to the turn 70.

The technical features of the embodiments and variants described here above, in particular the second and third embodiments, may be combined to form new embodiments of the invention.

The invention claimed is:

1. A drive system for driving a screen, comprising:

an actuator configured to drive in rotation a winding tube acting on the screen;

a compensation spring, which is mounted around the actuator and formed by a wire that is wound to have plural turns; and at least one ring made of plastic material and placed between two adjacent turns of the compensation spring, wherein an external radius of the ring is greater than a maximum external radius of the compensation spring.

2. The drive system according to claim 1, wherein the ring comprises a cylindrical external wall configured to come into contact with an internal surface of the winding tube.

3. The drive system according to claim 2, wherein a width of the external wall is greater than a diameter of the wire forming the compensation spring.

4. The drive system according to claim 1, wherein the ring comprises a cylindrical internal wall, and wherein an internal radius of the ring is less than a minimum internal radius of the compensation spring.

5. The drive system according to claim 4, wherein a width of the internal wall is greater than a diameter of the wire forming the compensation spring (7).

6. The drive system according to claim 1, wherein the ring has an attachment means for attaching to a turn of the compensation spring.

7. The drive system according to claim 1, wherein the ring has a circumferential length that is greater than one of the turns of the compensation spring about a central axis of the drive system.

8. The drive system according to claim 1, further comprising:

a plurality of rings that are each placed between two adjacent turns of the compensation spring distributed at different locations of the compensation spring along a central axis of the drive system.

9. The drive system according to claim 1, wherein the compensation spring comprises a first series of contiguous turns, which have at rest a first spacing, and at least one second series of non-contiguous turns, which have at rest a second spacing that is greater than the first spacing.

10. A closure, screening, or solar protection system installation that comprises a screen, a frame, a winding tube, and a drive system according to claim 1.

11. The drive system according to claim 3, wherein the width of the external wall is multiple times greater than the diameter of the wire forming the compensation spring.

12. The drive system according to claim 5, wherein the width of the external wall is multiple times greater than the diameter of the wire forming the compensation spring.

13. The drive system according to claim 2, wherein the ring comprises a cylindrical internal wall, and wherein an internal radius of the ring is less than a minimum internal radius of the compensation spring.

14. The drive system according to claim 3, wherein the ring comprises a cylindrical internal wall, and wherein an internal radius of the ring is less than a minimum internal radius of the compensation spring.

15. The drive system according to claim 2, wherein the ring has an attachment means for attaching to a turn of the compensation spring.

16. The drive system according to claim 3, wherein the ring has an attachment means for attaching to a turn of the compensation spring.

17. The drive system according to claim 4, wherein the ring has an attachment means for attaching to a turn of the compensation spring.

18. The drive system according to claim 5, wherein the ring has an attachment means for attaching to a turn of the compensation spring.

19. The drive system according to claim 2, wherein the ring has a circumferential length that is greater than one of the turns of the compensation spring about a central axis of the drive system.

20. The drive system according to claim 3, wherein the ring has a circumferential length that is greater than one of the turns of the compensation spring about a central axis of the drive system.

21. The drive system according to claim 4, wherein the ring has a circumferential length that is greater than one of the turns of the compensation spring about a central axis of the drive system.

22. The drive system according to claim 5, wherein the ring has a circumferential length that is greater than one of the turns of the compensation spring about a central axis of the drive system.

* * * * *